US008109223B2

(12) United States Patent
Jamieson

(10) Patent No.: US 8,109,223 B2
(45) Date of Patent: Feb. 7, 2012

(54) APPARATUS AND METHOD FOR OPERATING AUTONOMOUS UNDERWATER VEHICLES

(75) Inventor: James Andrew Jamieson, Aberdeenshire (GB)

(73) Assignee: Subsea 7 Limited, Aberdeen (GB)

( * ) Notice: Subject to any disclaimer, the term of this patent is extended or adjusted under 35 U.S.C. 154(b) by 101 days.

(21) Appl. No.: 12/250,913

(22) Filed: Oct. 14, 2008

(65) Prior Publication Data

US 2009/0095209 A1 Apr. 16, 2009

(30) Foreign Application Priority Data

Oct. 12, 2007 (GB) ..... 0719946.6

(51) Int. Cl.
*B63G 8/00* (2006.01)

(52) U.S. Cl. ..... 114/312

(58) Field of Classification Search ..... 114/312, 114/315

See application file for complete search history.

(56) References Cited

U.S. PATENT DOCUMENTS

| | | | | |
|---|---|---|---|---|
| 4,802,517 | A * | 2/1989 | Laster | 144/34.5 |
| 5,995,882 | A * | 11/1999 | Patterson et al. | 701/21 |
| 6,142,092 | A * | 11/2000 | Coupland | 114/331 |
| 6,223,675 | B1 * | 5/2001 | Watt et al. | 114/312 |
| 6,390,012 | B1 * | 5/2002 | Watt et al. | 114/322 |
| 6,472,768 | B1 * | 10/2002 | Salls | 290/54 |
| 7,077,072 | B2 * | 7/2006 | Wingett et al. | 114/312 |
| 2007/0274635 | A1 * | 11/2007 | Oney | 385/39 |
| 2008/0144442 | A1 * | 6/2008 | Combee et al. | 367/131 |
| 2009/0287414 | A1 * | 11/2009 | Vickery | 701/220 |

FOREIGN PATENT DOCUMENTS

| | | | |
|---|---|---|---|
| GB | 2 004 818 | A | 4/1979 |
| JP | 72223589 | A | 8/1995 |
| JP | 08145733 | A | 6/1996 |

* cited by examiner

*Primary Examiner* — Stephen Avila
(74) *Attorney, Agent, or Firm* — Levy & Grandinetti

(57) ABSTRACT

A method and apparatus of operating an autonomous underwater vehicle (AUV) may include receiving an AUV in a receptacle of a submersible station. The AUV and the submersible station may be launched to an underwater location. The AUV may engage with the submersible station before, after or during a mission, and may return to the same or a different submersible station after part, or all, of the mission has been completed.

36 Claims, 5 Drawing Sheets

APPARATUS AND METHOD FOR OPERATING AUTONOMOUS UNDERWATER VEHICLES

RELATED APPLICATIONS AND CLAIM OF PRIORITY

This patent application claims priority to GB Patent Application No. 0719946.6, filed Oct. 12, 2007, the disclosure of which is incorporated herein by reference in its entirety.

NOT APPLICABLE

BACKGROUND

Autonomous underwater vehicles (AUVs) are normally launched into the water from a surface support vessel by a simple wire hoist. The AUV does not have an umbilical, and thus there are no hard wire/live links with the vehicle, which can be used to facilitate the launch and recovery process to and from the vessel. Once an AUV has been lowered from the deck of the support vessel to the water surface, the AUV is manually released from the hoist so it can then submerge and accomplish its mission. The hoist line is manually attached to the AUV for recovery to the deck after the mission.

Both launch and recovery to and from the vessel are difficult in rough weather.

SUMMARY

In an embodiment, a method of operating an AUV may include providing a submersible station that may engage with the AUV, submerging the submersible station and engaging the AUV with the submersible station before, after or during a mission.

The AUV may engage with the station on the deck of a support vessel from which it is launched, and the AUV and station may be launched into the water as a unit. In an embodiment, the AUV can return to the same or a different station after part or all of its mission has been completed.

In an embodiment, the AUV can be launched separately from the station, from the same or a different vessel, and can be docked with the station when underwater, prior to commencement of the mission.

In an embodiment, the AUV can be deployed on a mission direct from the vessel without engaging with the station before commencement of the mission, and can engage with the station only after part (or all) of its mission has been completed.

In an embodiment, an apparatus for operating an AUV, may include a submersible station having a receptacle to receive the AUV, the station being adapted to be lifted by a lifting device to facilitate deployment of the station and AUV from a vessel to an underwater location.

The submersible station may be launched from the vessel to a location on the sea bed or on a fixed structure, so that the station is static at the times of engagement and disengagement of the AUV. The station may house the AUV within a protective housing and thereby may provide a "garage" which provides protection from the elements as the AUV is launched through the air/water transition zone, and a static base on the sea bed which the AUV can engage before, during or after its mission.

The station can have a receptacle for the AUV, which can have a shape adapted to receive the AUV being used, which may vary in different embodiments. The receptacle can be set in a square base plate. The station can incorporate weights or ballast, and can incorporate flow paths configured to enhance the hydrodynamics of the station when being lowered from a surface vessel. In an embodiment, the station can have a base plate with a lattice construction to facilitate its passage through the water.

The station can have guide surfaces that are sloped, channeled or funneled towards the receptacle, which can facilitate engagement of the AUV with the station, by guiding it passively to the edge of the receptacle. In an embodiment, the guide surfaces can include flat sloping faces arranged at an angle to the base plate, adapted to guide movement of the AUV up to the level of the entrance to the receptacle. The AUV can then enter the receptacle by advancing until in alignment with an opening for the receptacle, and then optionally descending into engagement with an optional latch mechanism.

The station can have at least one lifting eye, arranged on a frame and can be lifted by a crane connected to the eye. The frame may span the receptacle and may have a connection mechanism for cooperation with the crane provided on the upper surface of the frame. The frame may have upright side portions and a cross bar that defines an opening that is adapted to allow passage by the AUV.

The station may include shock absorbers to provide a soft landing on the seabed, thus, the shock absorbers can configured to facilitate damage-free landing on the seabed. Once landed, the station can be decoupled from the vessel motion by a float device in the lift line which can be left slack because it is held clear of the seabed by the float device.

The AUV may be loaded into the receptacle on the deck of the vessel at the surface, and the assembly of the AUV and the station may be launched as a unit into the water from the vessel using lifting devices such as, but not limited to, a winch, a hoist, a crane, an A-frame and/or any other suitable and available lifting device, such as a wire hoist, on the vessel. The lifting device may have a lift line which may be, but is not limited to, a wire and/or a rope. The initial launching operation of this type may be quite similar to a routine lift to the seabed, avoiding the need to use any particular form of specialized lifting equipment. In an embodiment, other suitable locking devices can be used.

The apparatus may incorporate a signaling system adapted for communication between the station, the AUV and a receiving vessel. The receiving vessel may be the vessel from which the station is deployed. The station can incorporate a signaling system to communicate (one-way or two-way) with the AUV or with the receiving vessel. The signaling system can include an acoustic beacon for determining the station's position relative to a known marker using a relative positioning system such as, but not limited to, a conventional ultra short base line system (USBL), provided on the receiving vessel. Other relative positioning systems can be used instead. The known marker may be the receiving vessel. The known marker may have a known fixed position, and thus it may take the form of an offshore and/or marine installation, for example, a wellhead installation, a navigation buoy or a lighthouse. This information can be combined with vessel global positioning system (GPS) coordinates to provide an accurate position of the station on the sea bed. This can provide the AUV with a datum start point for an optional on-board navigation system.

In the event that the support vessel does not have a USBL, the absolute station position can be estimated by other means, such as, but not limited to, observed lift line position, and the vessel GPS coordinates.

In an embodiment, the station can be disconnected from the wire hoist after lowering the assembly of the AUV and the station to the desired position, although it can optionally remain connected during the mission of the AUV, if desired. Disconnection can be by a remotely operated underwater vehicle (ROV) operated hook or by an acoustic release system. Reconnection of the station to the wire hoist of the vessel after the AUV has been deployed (and optionally recovered) can be by an ROV operated hook.

The station can have a self operating latch mechanism for retaining the AUV optionally within the receptacle. This can advantageously be centrally placed in the receptacle, in the floor. Latching can be achieved by the AUV entering the receptacle and driving a built in socket over the latch. The latter can have spring loaded locking levers that can automatically retract and then extend behind an inwardly extending rim on the AUV socket.

The AUV/station engaging operation can compress a spring loaded collar, which can remain energized against the AUV socket after the latch has operated to retain the vehicle. The AUV can optionally release itself by extending a probe that retracts the locking levers and the AUV is then pushed clear of the latch by the action of the energized spring.

In order to extend the mission time of the AUV, an embodiment of the garage can include a power supply such as a battery. The power supply can optionally be used to charge the on-board battery or other power supply on the AUV. In an embodiment, the power supply can include a generator and an embodiment can incorporate a water flow driven generator. The water flow driven generator may include, but is not limited to, a turbine or an oscillatory generator. The water flow driven generator may be a tidal generator which can be removed or installed on the base plate as necessary. The tidal generator can be mounted on and/or connected to a battery pack. The battery pack may be configured to provide a reservoir of power for recharging the AUV thereby extending its mission time. The level of charge in the station and in the AUV can be monitored and optionally compared by the operator. This can allow the AUV operator to optimize the recharging regime, for example, by directing the AUV to engage a particular station with sufficient power to recharge the on-board AUV batteries and to avoid engagement with stations that have depleted power supplies. The provision of a power supply in the station may mean that AUV missions can in principle be extended indefinitely, as the AUV can simply return to a recharging station every time its on-board power supply drops below a certain level. The AUV may be triggered to return to a selected station for recharging upon reaching a threshold of power depletion. The reaching of the threshold value may trigger the return of the AUV to the station. The threshold may be set sufficiently high to enable the AUV to reach the station under the remaining power stored in the AUV power supply.

The level of charge in the station and vehicle can optionally be monitored by the vehicle and/or station, and in an embodiment, the vehicle itself can optionally determine the charging regime so that an operator is not required.

The power supply can be configured to drive a data handling package, that can accept data transmitted or downloaded from the AUV for acoustic transmission to a surface facility or vice versa. A number of these stations can be strategically positioned in the AUV mission area (e.g. around a field development) to allow the AUV to complete an extensive and comprehensive survey or other tasks, without being recovered to surface.

The station can include a stab connector that can be accessed by the AUV to provide signal and power transfer. In an embodiment, transmission of signals and power between the AUV and the station can be wireless, for example, by an induction or an acoustic mechanism. In an embodiment, the AUV may include a matching connector that can be mated on command with its counterpart on the base plate, by means of a hydraulic cylinder (or similar extensor).

In an embodiment, a system for operating an AUV may include a submersible station, an AUV and a lifting device, wherein the lifting device is configured to deploy a vessel to the submersible station from an underwater location and the submersible station includes a receptacle configured to receive the AUV before, after or during a mission.

In an embodiment, a method of operating an AUV may include engaging an AUV with a submersible station, connecting the submersible station to a lift wire of a lifting device located on a vessel, deploying the submersible station from the vessel to an underwater location using the lifting device and decoupling the station from motion of the vessel during a mission.

The method may include fitting a floatation device to the lift wire wherein the flotation device may be configured to decouple the submersible station from motion of the vessel. The method may include disconnecting the lift wire from the station.

In an embodiment, a method of deploying an AUV may include receiving an AUV in a receptacle of a submersible station, lowering the station and the AUV as a unit from a vessel to an underwater location and moving the AUV from the station to perform a mission.

In an embodiment, a method of operating an AUV may include submerging a first submersible station and engaging the AUV with the first submersible station before, after or during a mission.

In an embodiment, an apparatus for operating an AUV may include an AUV, a submersible station adapted to engage with the AUV before, after or during a mission and a lifting device adapted to deploy at least one of the AUV and the submersible station from a vessel to an underwater deployment location.

One or more embodiments including the embodiments disclosed above may be combined within the scope of this disclosure.

BRIEF DESCRIPTION OF THE DRAWINGS

Aspects, features, benefits and advantages of the embodiments described herein will be apparent with regard to the following description, appended claims and accompanying drawings where:

DETAILED DESCRIPTION

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

As used herein and in the appended claims, the singular forms "a," "an," and "the" include the plural reference unless the context clearly dictates otherwise. Unless defined otherwise, all technical and scientific terms used herein have the same meanings as commonly understood by one of ordinary skill in the art. As used herein, the term "comprising" means "including, but not limited to."

Figure 1:
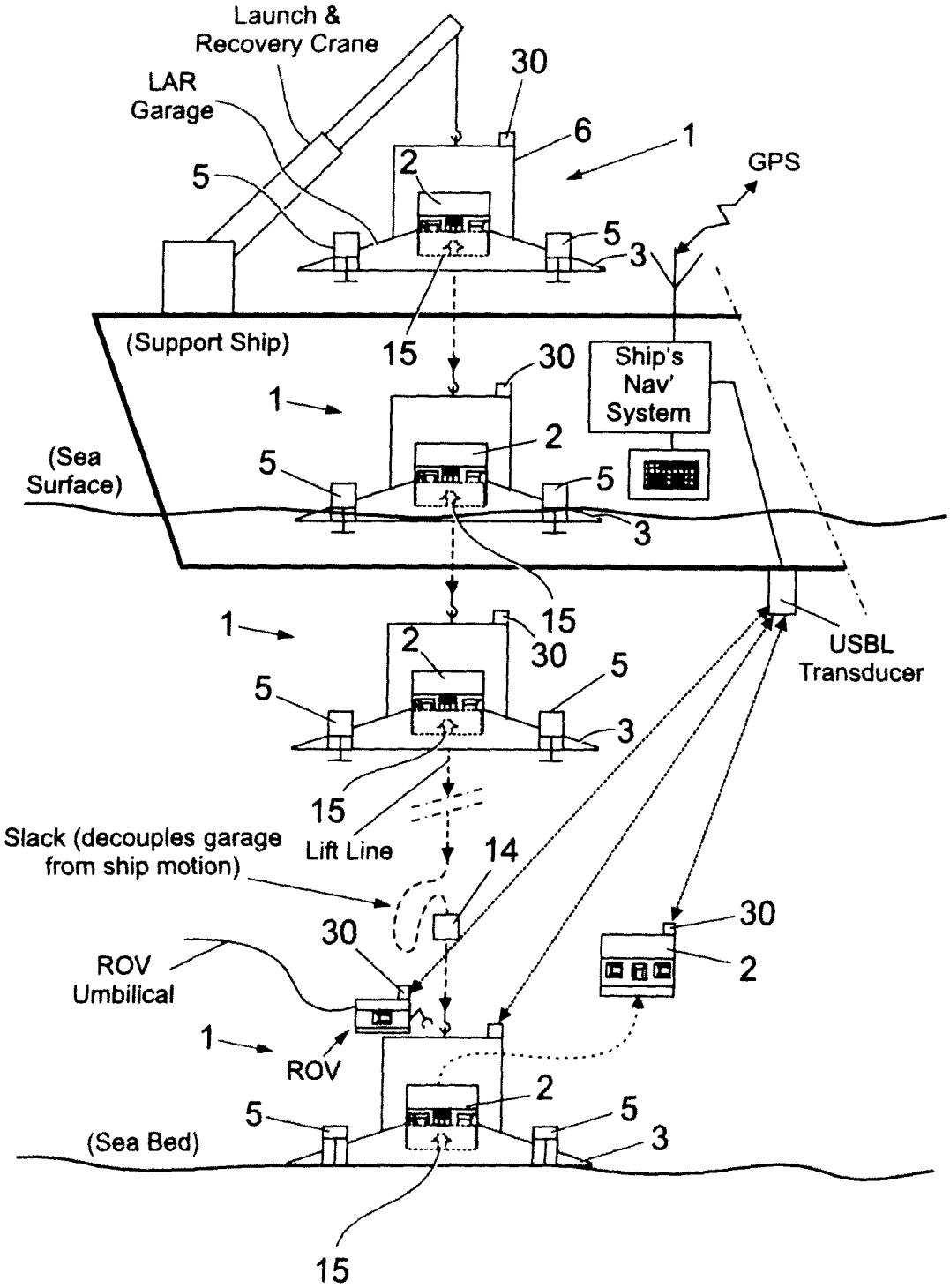
FIG. 1 depicts a schematic side view of the method and vessel for operating an AUV according to an embodiment.
Figure 2:
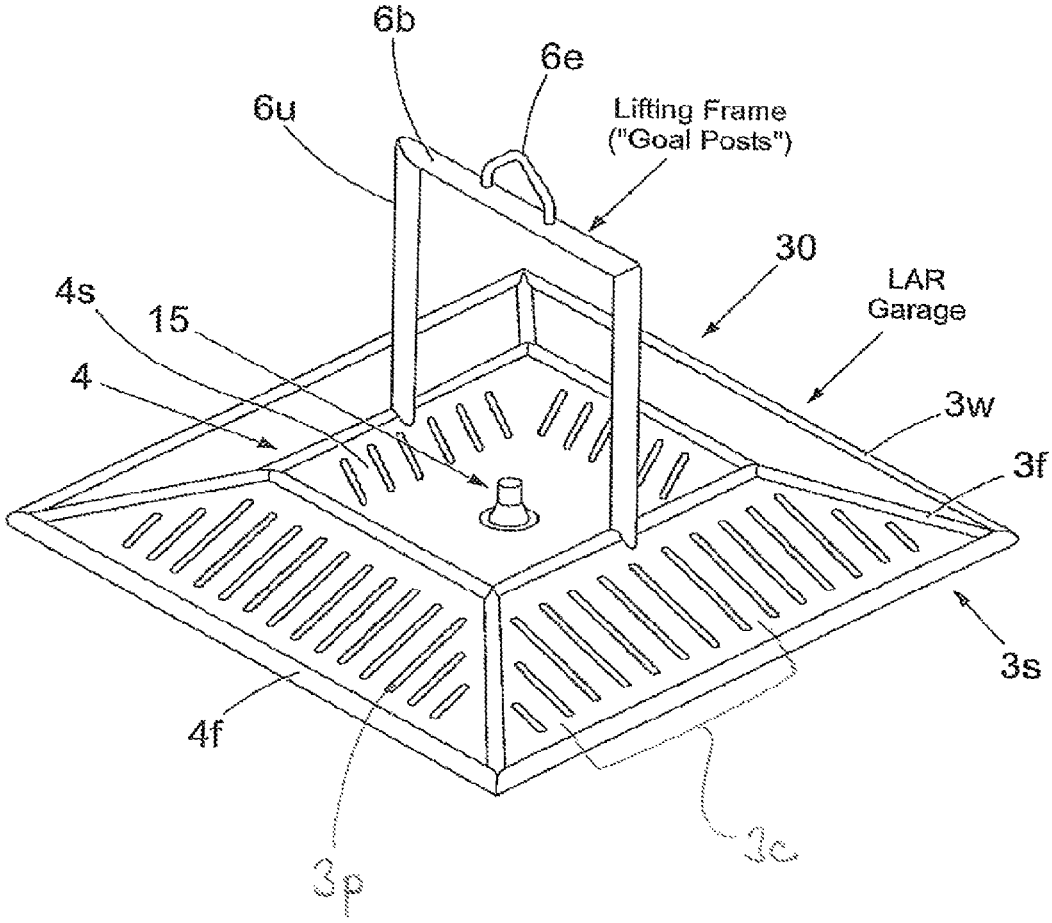
FIG. 2 depicts a schematic perspective view of a station used in the method of FIG. 1 according to an embodiment.

Referring now to FIGS. 1 and 2, a station 1 for engagement with an AUV 2 may includea base plate 3 with a general pyramid structure having a flat lower surface 3*s* and at least three (or four) sloped side walls 3*w*. The sloped side walls 3*w* may be formed in panels and attached to a frame 3*f* that defines the pyramid structure. The side walls 3*w* may have flat faces that converge towards the apex, but the wide walls 3*w* may not meet at the apex, but instead define an aperture in the upper surface of the pyramid structure, on the opposite face to the flat lower surface 3*s*. The aperture may be defined by portions of the frame 3*f* and may define the entrance to an AUV receptacle 4 having sides 4*s* and a floor 4*f*. The receptacle 4 may be adapted to receive the AUV 2, and optionally may have a latching mechanism 15 to latch the AUV 2 into place within the receptacle. The latching mechanism 15 can be located in the floor 4*f* of the receptacle, but other locations (side wall 4*s* or frame 3*f*) can be used for this purpose.

Referring now to FIGS. 1 and 2, a station 1 for engagement with an AUV 2 may include a base plate 3 with a general pyramid structure having a flat lower surface 3*s* and at least three (or four) sloped side walls 3*w*. The sloped side walls 3*w* may be formed in panels and attached to a frame 3*f* that defines the pyramid structure. The three (or four) sloped side walls 3*w* have flow paths 3*p* through which water can pass. Collectively the flow paths 3*p* provide a lattice construction 3*c* to facilitate passage of the station 1 through water. The side walls 3*w* may have flat faces that converge towards the apex, but the wide walls 3*w* may not meet at the apex, but instead define an aperture in the upper surface of the pyramid structure, on the opposite face to the flat lower surface 3*s*. The aperture may be defined by portions of the frame 3*f* and may define the entrance to an AUV receptacle 4 having sides 4*s* and a floor 4*f*. The receptacle 4 may be adapted to receive the AUV 2, and optionally may have a latching mechanism 15 to latch the AUV 2 into place within the receptacle. The latching mechanism 15 can be located in the floor 4*f* of the receptacle, but other locations (side wall 4*s* or frame 3*f*) can be used for this purpose. The base plate 3 may include a lifting frame 6 with uprights 6*u* and a cross bar 6*b*, having a lifting eye 6*e* suitable for cooperating with a wire hoist on a vessel to be used for launching and recovering the AUV 2. Once the AUV 2 is latched into the receptacle 4 on the deck of the vessel, the lifting eye 6*e* may be connected to the wire hoist of the vessel and the combined assembly of the station 1 and the AUV 2 may be lifted by the wire hoist, swung outboard and lowered into the water as shown in FIG. 1.

The assembly of the station 1 and the AUV 2 may be lowered into the water quickly, thereby minimizing the time for transit through the air/water interface. Thereafter, the assembly may be lowered to a fixed location on the sea bed. The actual landing of the station can be timed to minimize the effects of ship motion on the wire hoist. Optionally, the base 3 can include shock absorbers 5 mounted on the lower surface 3*s* of the base in order to minimize the impact on landing. Once landed, the lift wire may be slackened, but may remain supported above the frame 6 by a flotation device 14. This may decouple the station 1 from the motion of the vessel.

The absolute position of the base 1 can be determined optionally using GPS combined with the vessel's USBL or by GPS and an estimated seabed location based on the lift line position. The datum for the AUV navigation system can be updated accordingly (and other mission details also transmitted/updated if necessary).

On command from the vessel, or from a timer, the AUV 2 may unlatch itself, and proceed on its mission, at the end of which it may return to the station 1. In the meantime, the station 1 can be recovered for subsequent redeployment elsewhere or at the same place, or disconnected from the support vessel and left on the sea bed in the same location for subsequent reattachment of the AUV 2. In an embodiment, disconnection of the wire hoist and the station 1 can be by ROV or by acoustic release, and reconnection can optionally be by ROV. The facility to disconnect or recover the garage may allow the support vessel to leave the site and undertake additional tasks whilst the AUV 2 executes its mission.

When the AUV 2 has completed its mission or when its available on-board power has dropped to a certain level, the AUV 2 may be triggered automatically to return to the location of the station 1 under the power remaining on the battery of the AUV 2. This trigger can be provided by an on-board system such as, but not limited to, a battery sensor or a timer, or can be a command from the vessel. When the AUV 2 is nearing the station, the geometric configuration of the lifting frame with the two uprights 6*u* and the cross bar 6*b* may assist in the AUV's identification of the correct target and in its assessment of, but not limited to, an approach vector, a speed and a distance. The AUV 2 can be programmed to approach the station from a predetermined angle that is favorable to the docking procedure in the receptacle 4, for example, where the uprights 6*u* and cross bar 6*b* are arranged in a plane that is perpendicular to the approach of the AUV 2. The sloped side walls 3*w* of the base plate 3 may assist in guiding the AUV to the entrance of the receptacle 4, as it swims up the ramps and into the entrance of the receptacle 4. Other guiding surfaces that control the lateral deviation from the optimal docking path of the AUV can be used to funnel the AUV into the entrance of the receptacle on approach. Other configurations of station can be used to guide the approach of the AUV 2.

The AUV 2 and the station 1 can have acoustic beacons 30 to communicate with the vessel's USBL system.

Figures 3A, 3B, 3C:
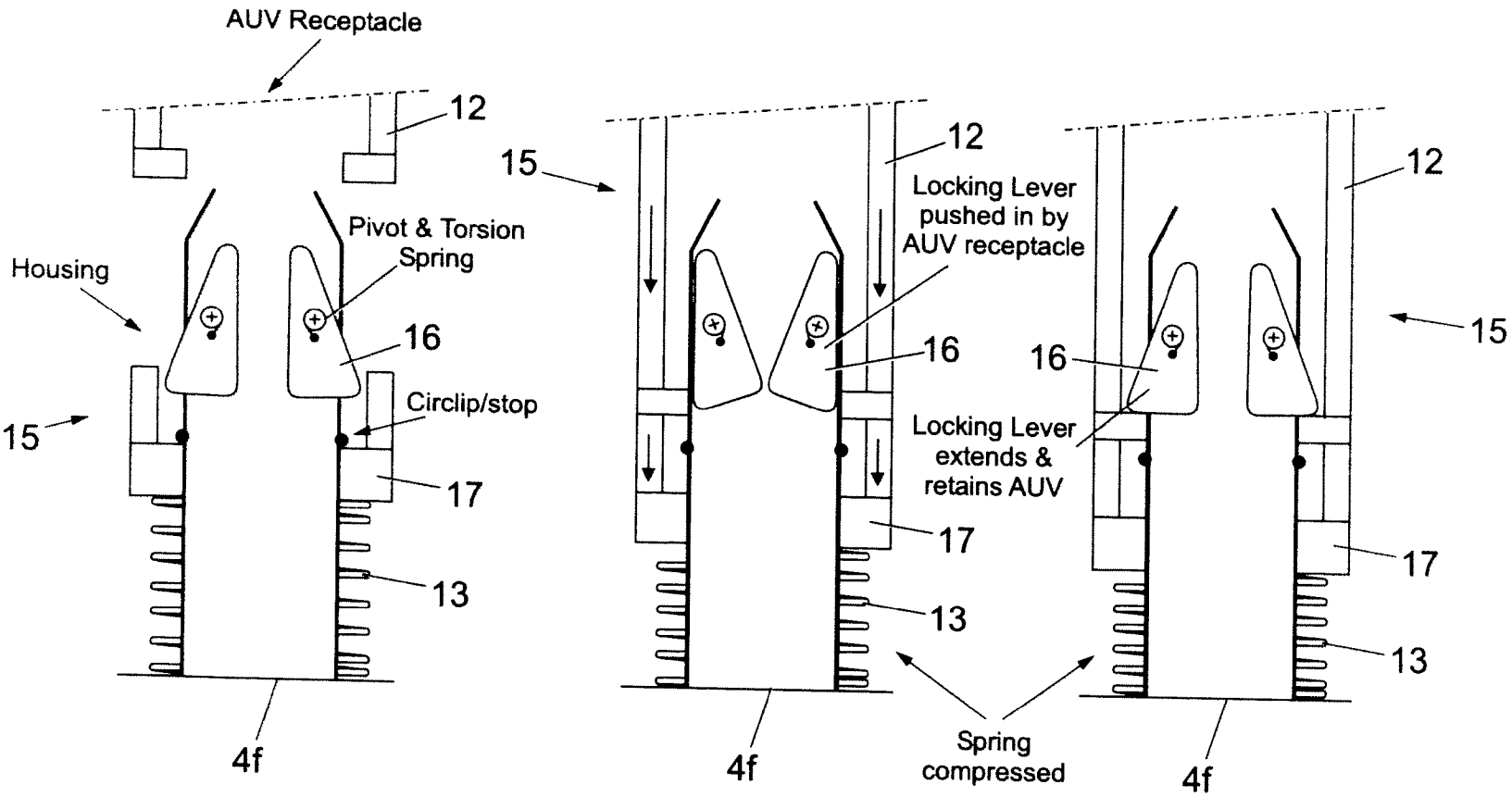
FIG. 3 depicts a schematic side view of a latching mechanism connecting the AUV to the station in FIGS. 1 and 2, showing the latching sequence according to an embodiment.
Figure 4A:
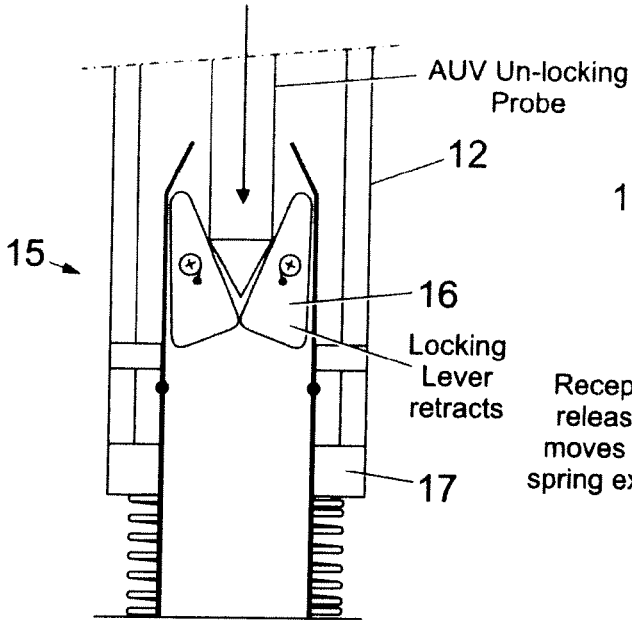
FIG. 4 depicts a more detailed view similar to FIG. 3, showing the releasing sequence according to an embodiment.
Figure 4B:
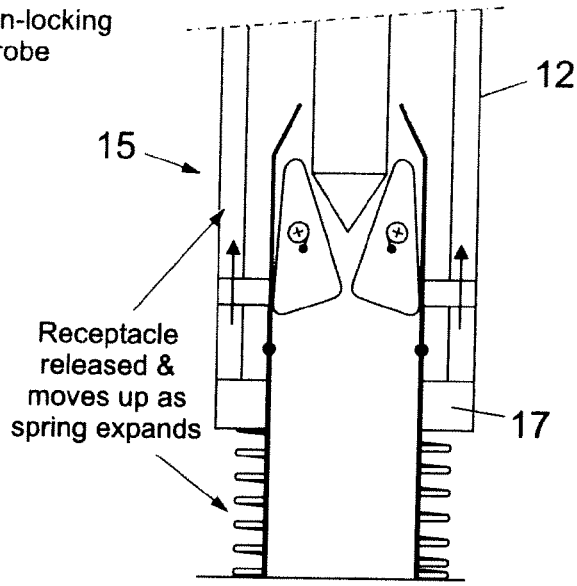
Figure 4C:
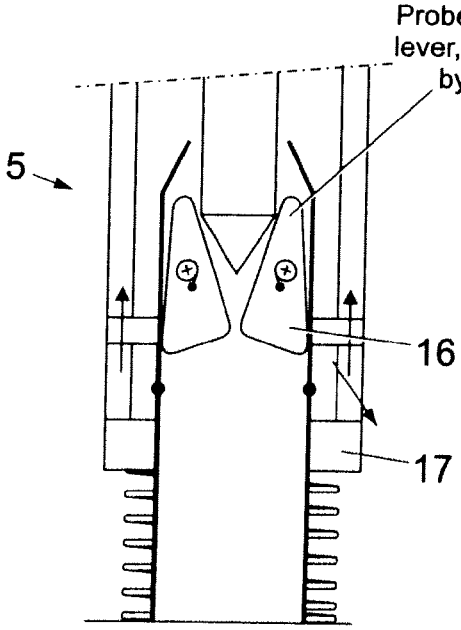
Figure 4D:
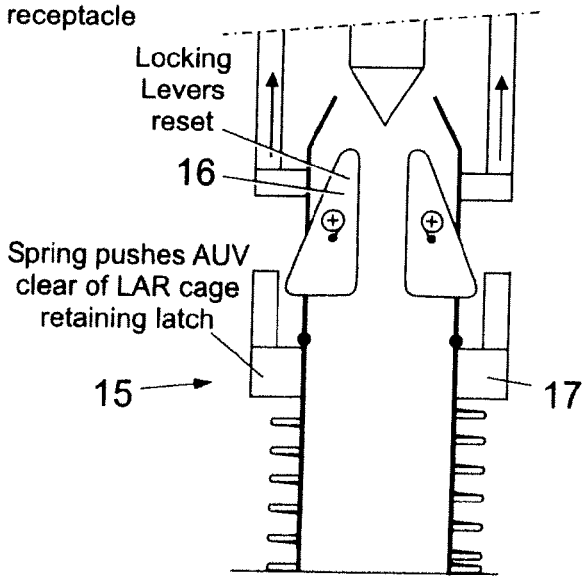

In an embodiment, the AUV 2 or the station 1 can have a disengagement mechanism that is energized by the docking process. As shown in FIG. 3, the AUV can be docked with the receptacle by a docking sleeve 12 and latching probe 11 which can mate with a latching mechanism 15 with a spring 13. When the sleeve 12 passes over the latching mechanism, it may compress the spring 13 between a collar 17 and the floor of the receptacle 4*f* as shown in FIG. 3. When the AUV is released from the latching mechanism, the AUV may insert the latching probe 11 into the bore of the latching mechanism on the receptacle 4. This may retract the locking levers 16 and may release the sleeve 12 of the AUV from the latching mechanism. The spring 13 may be free to expand and push the AUV away from the floor of the receptacle 4 as shown in FIG. 4.

Figure 5:
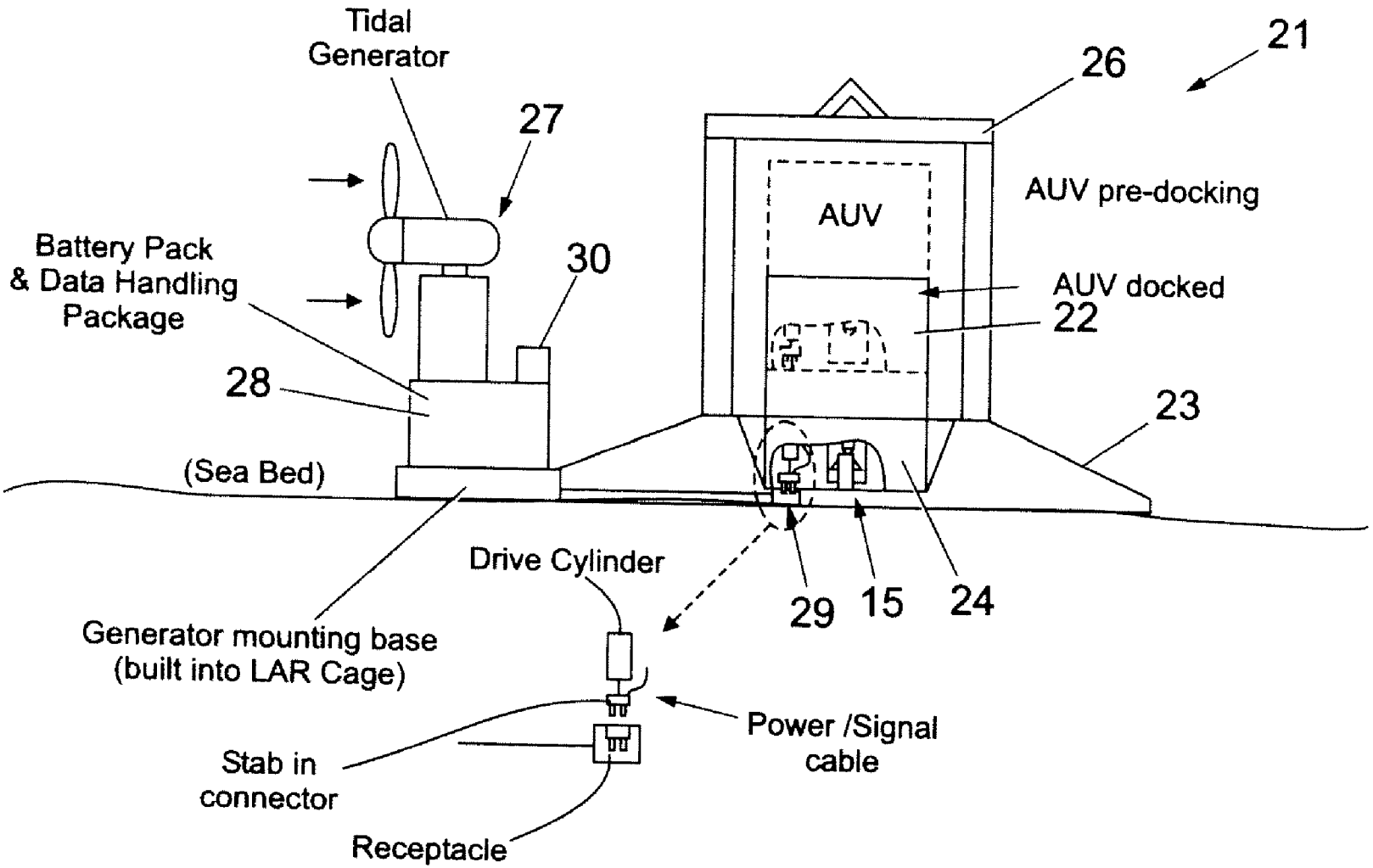
FIG. 5 depicts a schematic side view of an alternative embodiment of the station with an optional power supply according to an embodiment.

An alternative embodiment of a station 21 is shown in FIG. 5 in which an optional power supply may be provided. In the station 21, similar components are used to the station 1, and like reference numbers have been used, with the prefix "2", so AUV 22, base plate 23 and lifting frame 26 are all basically similar to the corresponding components described above. In the station 21, the difference may reside in the connections between the station 21 and the AUV 22, and in the power supply. The power supply may include a tidal generator 27 and an optional battery pack 28. The tidal generator 27 may have a rotor with vanes turned by tidal movements, which is converted to electrical energy by the generator 27. The generator may charge the battery 28 whenever the rotor is turned at sufficient speed. The battery can be connected to the AUV 22 by the power and signal connectors 29 in the receptacle 24, so the AUV 22 can be charged after docking with the station 21. The battery 28 may be kept charged by the generator 27 so that if the AUV's on board battery is depleted during a mission it can return to the station 21 and the on-board battery on the AUV can be recharged from the battery 27 and/or directly from the generator. Thus, the AUV 22 can remain submerged for numerous missions without returning to the vessel. This frees the vessel from remaining on station during each mission of the AUV 22.

In an embodiment, a single AUV (or multiple AUVs) can be deployed from a number of stations 1, 21 strategically located around a field site and an AUV can be programmed to locate the nearest power station 21 when its on-board battery is depleted to a set level. The AUV can be provided with a navigation device to determine its position and on-board communications systems such as an acoustic beacon 30 needed to transfer acoustic data between the AUV and the vessel. When the AUV has docked with a base station (or is within wireless or acoustic range) it can optionally download data and update its mission parameters through the stab connector 29 or via the acoustic beacon 30.

Using the stations 1, 21 can save on the AUV power consumption as it is not necessary to drive the AUV from the surface to the seabed. By handling the AUV in an underwater "garage" the commencement and conclusion of missions may be significantly less weather dependent as the need for "manual" surface release/reconnection arrangements during conventional launch and recovery operations may be avoided. It follows from this that the need to terminate a mission, in order to safely recover the vehicle in the event of bad weather, may also be avoided. Because the stations can be recovered to the vessel after disengagement of the AUV or just left on the seabed, the AUV support vessel can be freed to accomplish other tasks in parallel with the AUV mission.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A method of operating an autonomous underwater vehicle (AUV), the method comprising:

providing a first submersible station that is configured to engage with the AUV, the first submersible station incorporating a ballast device, flow paths and a power supply being a water flow driven generator located subsea, the AUV having an on-board battery, the power supply being configured to charge the on-board battery of the AUV;

submerging the first submersible station from a vessel, the flow paths configured to facilitate passage of the submersible station through the water when it is lowered from the vessel; and engaging the AUV with the first submersible station, wherein engaging the AUV with the first submersible station comprises engaging the AUV with the first submersible station on a deck of a support vessel from which the AUV is launched, and wherein submerging the first submersible station comprises launching the AUV and first submersible station into water as a unit.

2. The method of claim 1, further comprising:

returning the AUV to the first submersible station after a mission is completed.

3. The method of claim 1, further comprising:

providing a second submersible station; and engaging the AUV with the second submersible station underwater after part of a mission is completed.

4. The method of claim 1, further comprising:

providing a second submersible station; and engaging the AUV with the second submersible station underwater.

5. The method of claim 4 wherein engaging the AUV with the second submersible station comprises locating the AUV in a receptacle provided in the second submersible station.

6. The method of claim 1 wherein engaging the AUV with the first submersible station comprises locating the AUV in a receptacle provided in the first submersible station.

7. The method of claim 1, further comprising:

locating the first submersible station at a location on a sea bed before launching the AUV from the first submersible station, so that the first submersible station is static at times of engagement and disengagement of the AUV.

8. An apparatus for operating an autonomous underwater vehicle (AUV), the apparatus comprising:

a submersible station having a receptacle configured to receive the AUV, the submersible station being adapted to be lifted by a lifting device to facilitate deployment of the submersible station and AUV from a vessel to an underwater location, the submersible station incorporating a ballast device and incorporating flow paths to facilitate passage of the submersible station through the water when it is lowered from the vessel, wherein the submersible station is configured to provide a protective housing for the AUV and wherein the submersible station includes a power supply being a water flow driven generator located subsea, the AUV having an on-board battery, the power supply being configured to charge the on-board battery of the AUV.

9. The apparatus of claim 8 wherein the flow paths of the submersible station are in a lattice construction.

10. The apparatus of claim 8 wherein the submersible station comprises a funnel device comprising sloping faces adapted to guide movement of the AUV to an entrance of the receptacle.

11. The apparatus of claim 8 wherein the submersible station comprises at least one lifting eye.

12. The apparatus of claim 8 wherein the submersible station comprises:

a frame with upright side portions, and a cross bar that defines an opening across the receptacle, wherein the opening is configured to allow passage by the AUV.

13. The apparatus of claim 8 wherein the submersible station comprises shock absorbers.

14. The apparatus of claim 8 wherein the submersible station comprises a self operating latch mechanism for retaining the AUV within the receptacle.

15. The apparatus of claim 8, further comprising:

a signaling system adapted for communication between the submersible station, the AUV and a receiving vessel.

16. The apparatus of claim 15 wherein the signaling system comprises an acoustic beacon provided on the submersible station for determining a position of the submersible station relative to a known marker using a relative positioning system.

17. The apparatus of claim 16 wherein the relative positioning system comprises an ultra short base line system (USBL) provided on the vessel.

18. The apparatus of claim 8, further comprising:

an absolute positioning system for estimating absolute position of the submersible station.

19. The apparatus of claim 8 wherein the water flow driven generator is configured to connect to a battery pack to be configured to provide a reservoir of power for recharging the AUV.

20. The apparatus of claim 18 wherein the power supply is configured to drive a data handling package that accepts data transmitted from the AUV and permits further transmission of the data to a surface facility.

21. The apparatus of claim 8 wherein the submersible station comprises a connector adapted to mate with the AUV.

22. The apparatus of claim 21 wherein the connector comprises a stab connector adapted to provide signal and power transfer between the submersible station and the AUV.

23. The apparatus of claim 8, further comprising:

a wireless transmission device configured to transmit at least one of data and power wirelessly between the AUV and the submersible station.

24. A system for operating an autonomous underwater vehicle (AUV), the system comprising:

a submersible station;

an AUV; and a lifting device, wherein the lifting device is configured to deploy the submersible station and AUV from a vessel to an underwater location, and wherein the submersible station includes a receptacle configured to receive the AUV, the submersible station incorporating a ballast device and incorporating flow paths configured to facilitate passage of the submersible station through the water when it is lowered from the vessel and wherein the submersible station includes a power supply being a water flow driven generator located subsea, the AUV having an on-board battery, the power supply being configured to charge the on-board battery of the AUV.

25. The system of claim 24 wherein the lifting device comprises one or more of: a crane; a winch; a hoist; and an A-frame.

26. The system of claim 24 wherein the system is selectably operable in a first deployed configuration, in which the submersible station is connected to the lifting device, and a second deployed configuration, in which the submersible station is disconnected from the lifting device.

27. The system of claim 26 wherein in the first deployed configuration, the lifting device comprises a lift line provided with a float device decoupling the submersible station from motion of the vessel.

28. The system of claim 26, further comprising:

a disconnection device configured to disconnect the submersible station from the lifting device for operation of the system in its second deployed configuration.

29. The system of claim 28 wherein the disconnection device comprises one or more of the following:

a remotely operated underwater vehicle (ROV) operated hook; and an acoustic release system.

30. The system of claim 24 wherein the AUV and the submersible station are selectably arranged in a first, latched configuration, in which the AUV is releasably retained in the submersible station by means of an AUV operable latch mechanism and a second, released configuration, in which the AUV is movable away from the submersible station.

31. The system of claim 30 wherein in the latched configuration, a spring loaded collar of the latch mechanism is compressed and remains energized against the AUV.

32. A method of operating autonomous underwater vehicle (AUV), the method comprising:

engaging an AUV with a submersible station, the submersible station incorporating a ballast device flow paths, and a power supply being a water flow driven generator located subsea, the AUV having an on-board battery, the power supply being configured to charge the on-board battery of the AUV;

connecting the submersible station to a lift wire of a lifting device located on a vessel;

deploying the submersible station from the vessel to an underwater location using the lifting device, the flow paths of the submersible station configured to facilitate passage of the submersible station through the water when it is lowered from the vessel; and decoupling the submersible station from motion of the vessel.

33. The method of claim 32, further comprising: fitting a floatation device to the lift wire, wherein the flotation device is configured to decouple the submersible station from motion of the vessel.

34. The method of claim 33, further comprising: disconnecting the lift wire from the submersible station.

35. A method of deploying an autonomous underwater vehicle (AUV), the method comprising:

removably receiving an AUV in a receptacle of a submersible station, the submersible station incorporating a ballast device flow paths, and a power supply being a water flow driven generator located subsea, the AUV having an on-board battery, the power supply being configured to charge the on-board battery of the AUV;

lowering the submersible station and the AUV as a unit from a vessel to an underwater location, the flow paths of the submersible station configured to facilitate passage of the submersible station through the water when it is lowered from the vessel; and moving the AUV away from the submersible station to perform a mission.

36. A method of operating an autonomous underwater vehicle (AUV), the method comprising:

providing a first submersible station that is configured to engage with the AUV, the first submersible station incorporating flow paths and a power supply being a water flow driven generator located subsea, the AUV having an on-board battery, the power supply being configured to charge the on-board battery of the AUV;

submerging the first submersible station from a vessel, the flow paths configured to facilitate passage of the submersible station through the water when it is lowered from the vessel; and engaging the AUV with the first submersible station; wherein engaging the AUV with the first submersible station comprises engaging the AUV with the first submersible station on a deck of a support vessel from which the AUV is launched, and wherein submerging the first submersible station comprises launching the AUV and first submersible station into water as a unit.

* * * * *